United States Patent [19]

Franco et al.

[11] 4,203,503

[45] May 20, 1980

[54] EXHAUST SILENCER FOR A RAILWAY LOCOMOTIVE

[75] Inventors: Luigi Franco, Turin; Giorgio Bertotti, Vinovo, both of Italy

[73] Assignee: Centro Richerche Fiat S.p.A., Orbassano, Italy

[21] Appl. No.: 34,038

[22] Filed: Apr. 27, 1979

[30] Foreign Application Priority Data

May 17, 1978 [IT] Italy ..... 53326/78[U]

[51] Int. Cl.[2] ..... F01N 1/08

[52] U.S. Cl. ..... 181/272; 181/273; 181/275

[58] Field of Search ..... 181/247, 250, 251, 255, 181/266, 268, 272, 273, 275, 276, 281; 105/452

[56] References Cited

U.S. PATENT DOCUMENTS

| | | | |
|---|---|---|---|
| 1,539,595 | 5/1925 | Powell | 181/281 |
| 1,735,789 | 11/1929 | Powell | 181/273 |
| 3,712,030 | 1/1973 | Priest | 181/258 |
| 4,064,962 | 12/1977 | Hunt | 181/272 |
| 4,164,266 | 8/1979 | Collin et al. | 181/273 |

*Primary Examiner*—L. T. Hix
*Assistant Examiner*—Benjamin R. Fuller
*Attorney, Agent, or Firm*—Sughrue, Rothwell, Mion, Zinn and Macpeak

[57] ABSTRACT

An exhaust silencer for a railway locomotive with a supercharged, six-cylinder diesel engine developing a power of about 200–250 HP has a cylindrical body closed at each end by an end wall and subdivided into three resonance chambers and three gas expansion chambers by five dished baffle-plates, the fourth and fifth baffle-plates each having four tube sections. To optimize the acoustic performance specific dimensions of the chambers, of the tube sections, of a perforated induction pipe and of an outlet pipe are prescribed.

7 Claims, 3 Drawing Figures

EXHAUST SILENCER FOR A RAILWAY LOCOMOTIVE

The present invention relates to exhaust silencers for railway locomotives.

More particularly, the invention is concerned with an exhaust silencer for a railway locomotive having a supercharged diesel engine with six cylinders and a power rating of about 200–250 HP.

Known silencers for railway locomotives usually comprise a hollow cylindrical body closed at each end by a respective end wall which is traversed by a through-pipe having a plurality of holes, the silencers having an internal acoustically insulating layer of fibreglass cladding. Silencers of this type function satisfactorily, but, with time, the fibreglass disintergrates and is lost with the exhaust gases, and, consequently, the efficiency of the silencer deteriorates.

The object of the present invention is to provide such a silencer which is manufactured from sheet metal without the use of fibreglass or other acoustically insulating materials, so as to avoid the aforesaid disadvantage, which is of simple construction and low cost, and which is constructed in such a way that it achieves a working efficiency comparable to that of silencers using fibreglass insulation.

According to the present invention there is provided an exhaust silencer for a railway locomotive having a supercharged diesel engine with six cylinders and a power rating of about 200–250 HP, comprising a hollow cylindrical body closed at each end by a respective end wall, said end walls being traversed, respectively, by a portion of an induction pipe and by a portion of an exhaust gas outlet pipe, characterised in that the silencer body has an internal diameter of 340 millimeters, a length of 2200 millimeters and comprises:

first, second and third resonance chambers arranged in series with respective lengths 710, 200 and 110 millimeters;

first, second and third dished baffle-plates defining respective said resonance chambers;

first, second and third expansion chambers with respective lengths of 330, 320 and 530 millimeters, said expansion chambers being arranged in series;

fourth and fifth dished baffle-plates defining said first and second expansion chambers, said third expansion chamber being defined by a respective said end wall, said fourth baffle-plate having four tubular ducts with internal diameters of 60 millimeters and respective centres situated about a circumference having a diameter of 180 millimeters which is concentric with the longitudinal axis of said body, said tubular ducts extending for a length of 46 millimeters into said first expansion chamber and for a length of 54 millimeters into said second expansion chamber, said fifth baffle-plate having four tubular ducts, with internal diameters of 60 millimeters and respective centres located upon a circumference, concentric with the longitudinal axis of the body, with a diameter of 180 millimeters, angularly displaced on said circumference by 45° with respect to the said ducts of the fourth baffle-plate, said ducts extending for a length of 69 millimeters into said second expansion chamber, and in that:

said portion of the induction pipe has an internal diameter of 140 millimeters and traverses the said resonance chambers, being in communication with each said chamber through a respective plurality of openings, said pipe extending into said first expansion chamber for a length of 34 millimeters, and said portion of said exhaust gas outlet pipe has an internal diameter of 140 millimeters, extending into said third expansion chamber for a length of 138 millimeters.

One embodiment of the invention will now be more particularly described, by way of example, with reference to the accompanying drawings, in which.

Figure 1:
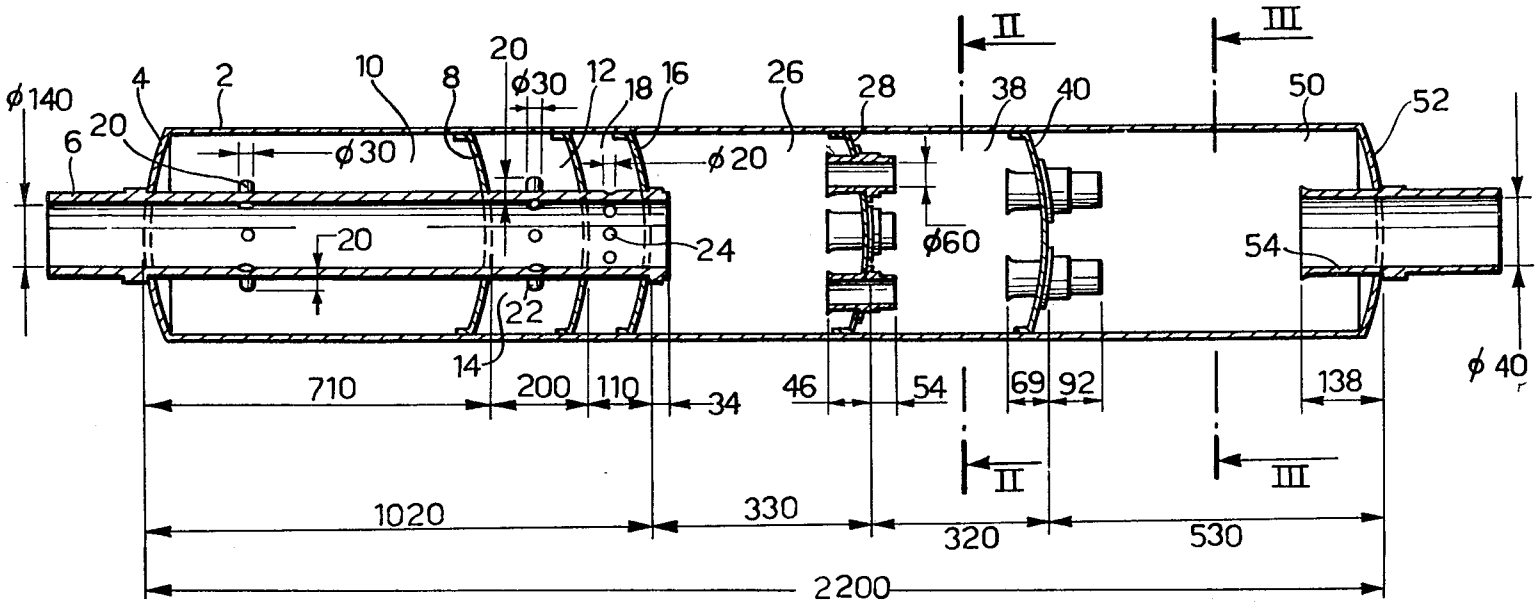
FIG. 1 is a longitudinal section of a silencer according to the invention.

Referring now to FIG. 1, there is shown a silencer comprising a cylindrical body 2 which has an internal diameter of 340 millimeters and is closed at one end by an end wall 4 which is traversed centrally by one end portion of an induction pipe 6 with an internal diameter of 140 millimeters. The induction pipe 6 is connected, at its other end, with an exhaust manifold of a diesel engine (not shown).

The portion of the induction pipe 6 which extends within the body 2 traverses a first convex baffle-plate 8 which is fixed to the pipe 6 and has a radius of curvature of 500 millimeters. The baffle-plate 8 is situated at a distance of 710 millimeters from the end wall 4 to define, with the latter, a first resonance chamber 10. The induction pipe 6 subsequently extends through a second, convex, baffle-plate 12 situated 200 millimeters from the first plate 8 to define a second resonance chamber 14, and a third, convex, baffle-plate 16 placed at a distance of 110 millimeters from the second plate 12 to delimit a third resonance chamber 18. The relative lengths of the three resonance chambers are so selected that the chambers are tuned to resonance at preselected frequencies present in the exhaust noise output of the engine.

The induction pipe 6 is in communication with the first resonance chamber 10, through a set of six radially-arranged, angularly equidistant, tubes 20, each having a length of 20 millimeters and an internal diameter of 30 millimeters, and with the second resonance chamber 14 through a similar set of six tubes 22. The induction pipe 6 is in communication with the third resonance chamber 18 through a set of ten, radially-arranged, angularly equidistant ports 24, each having a diameter of 20 millimeters.

The induction pipe 6 extends for an additional 34 millimeters to open into a first gas expansion chamber 26 which is defined by the third baffle-plate 16 and a fourth, convex, baffle-plate 28 located 330 millimeters from the third plate. The fourth baffle-plate 28 is similar to the aforesaid baffle-plates 8, 12, 16 in having a radius of curvature of 500 millimeters.

Figure 2:
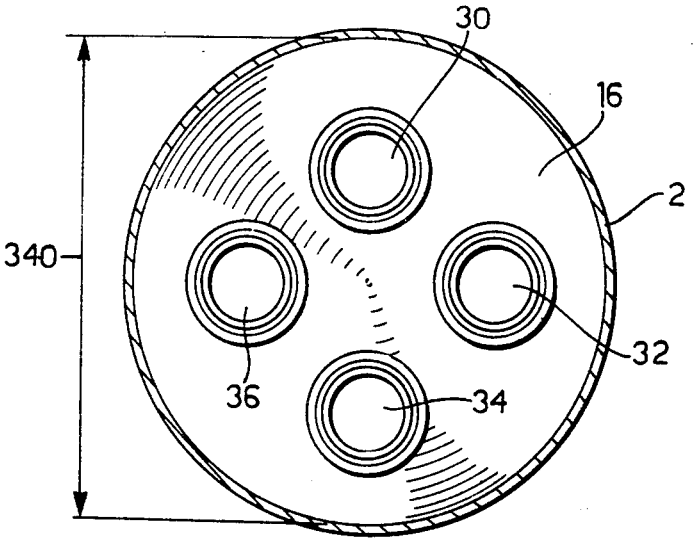
FIG. 2 is a cross-section, on an enlarged scale, taken along the line II—II of FIG. 1.

As shown, particularly in FIG. 2, the fourth baffle-plate 28 has four tubular ducts, comprising stub-pipes 30, 32, 34, 36, each with a respective stiffening collar and an internal diameter of 60 millimeters. The respective centres of the stub-pipes 30, 32, 34, 36 are arranged about a circumference with a diameter of 180 millimeters which is concentric with the longitudinal axis of the body 2. The stub-pipes 30, 32, 34, 36 extend for a length of 46 millimeters, including the stiffening collar, within the first expansion chamber 26 and have slightly flared ends. The pipes 30, 32, 34, 36 also extend for a length of 54 millimeters into a second expansion chamber 38 which is defined by a fifth, similarly convex, baffle-plate 40, located 320 millimeters from the fourth plate 28.

Figure 3:
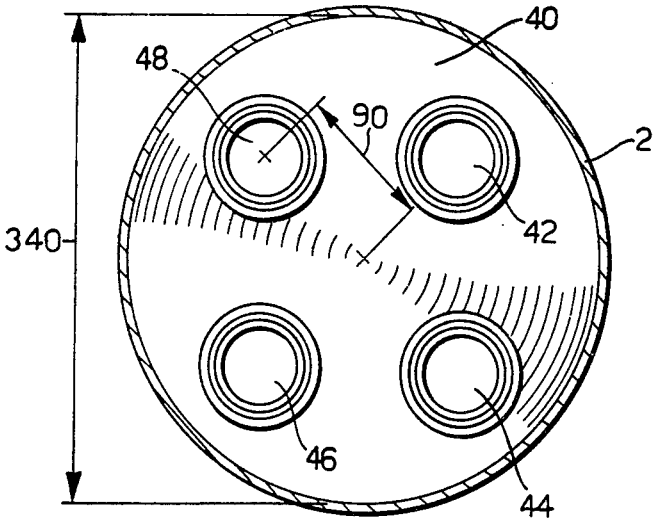
FIG. 3 is a cross-section, on an enlarged scale, taken along the line III—III of FIG. 1.

As shown in FIG. 3, the fifth baffle-plate 40 has four tubular ducts, comprising stub-pipes 42, 44, 46, 48, each with a respective stiffening collar and an internal diameter of 60 millimeters. These pipes 42, 44, 46, 48 are arranged, angularly displaced by 45°, with respect to the pipes 30, 32, 34, 36 on the fourth baffle-plate 28, about a circumference with a diameter of 180 millimeters which is concentric with the longitudinal axis of the body 2.

The stub-pipes 42, 44, 46, 48 extend, including the stiffening collar, for a length of 69 millimeters within the second expansion chamber 38 and have slightly flared ends. The pipes 42, 44, 46, 48 also extend for a length of 92 millimeters within a third expansion chamber 50 which is defined by an end wall 52 of the other end of the body 2, located 530 millimeters from the fifth baffle-plate 40.

The end wall 52 is traversed, centrally, by a portion of an exhaust gas outlet pipe 54 which has an internal diameter of 140 millimeters and extends within the third expansion chamber 50 for 138 millimeters. The pipe 54 has a stiffening collar adjacent the end wall 52 and its end within the chamber 50 is slightly flared.

The silencer operates as follows: the exhaust gases from the engine enter the silencer through the induction pipe 6, which conducts the gases through the three resonance chambers 10, 14 and 18 in succession, the resonance chambers absorbing acoustic energy at the respective frequencies to which they are tuned so as to effect a three-stage reduction in the noise level of the gases. On entering the first expansion chamber 26, the gases expand before passing through the stub-pipes 30, 32, 34, 36 to the second expansion chamber 38 and, subsequently, through the stub-pipes 42, 44, 46, 48 into the third chamber 50 before being discharged through the outlet pipe 54. The successive expansions of the gases in the expansion chambers 26, 38, 50 serve to dissipate the remaining acoustic energy in the exhaust gases.

The described dimensions must not have a tolerance greater than ±1 millimeters in order to optimise the acoustic performance of the silencer.

What is claimed is:

1. Exhaust silencer for a railway locomotive having a supercharged diesel engine with six cylinders and a power rating of about 200–250 HP comprising:

a hollow cylindrical body;

respective end-walls closing the opposite ends of said body;

an induction pipe, a portion of which traverses one said end-wall, and an exhaust gas outlet pipe traversing the other said end-wall, wherein the improvement consists in said silencer body having an internal diameter of 340 millimeters, a length of 2200 millimeters and comprising:

a first dished baffle-plate located 710 millimeters from said one end-wall;

a first resonance chamber defined by said one end-wall and said first baffle-plate;

a second dished baffle-plate located 200 millimeters from said first baffle-plate;

a second resonance chamber defined by said first and second baffle-plates;

a third dished baffle-plate located 110 millimeters from said second baffle-plate;

a third resonance chamber defined by said second and third baffle-plates;

a fourth dished baffle-plate located 330 millimeters from said third baffle-plate;

a first gas expansion chamber defined by said third and fourth baffle-plates;

a fifth dished baffle-plate located 320 millimeters from said fourth baffle-plate and 530 millimeters from said other end-wall;

a second gas expansion chamber defined by said fourth and fifth baffle-plates;

a third gas expansion chamber defined by said fifth baffle-plate and said other end-wall;

four tubular ducts supported by said fourth baffle-plate and having respective internal diameters of 60 millimeters and respective centres equally spaced about a circumference, concentric with the longitudinal axis of said body, with a diameter of 180 millimeters, each of said ducts extending for a length of 46 millimeters into said first expansion chamber and for a length of 54 millimeters into said second expansion chamber;

four tubular ducts supported by said fifth baffle-plate and having respective internal diameters of 60 millimeters and respective centres located upon a circumference, concentric with said longitudinal axis of said body, with a diameter of 180 millimeters and angularly displaced by 45° with respect to said ducts on said fourth baffle-plate, said four tubular ducts on said fifth baffle-plate extending into said second gas expansion chamber for a length of 69 millimeters and into said third gas expansion chamber for a length of 92 millimeters, and wherein:

said resonance and gas expansion chambers are arranged in series longitudinally of the body;

said portion of said induction pipe has an internal diameter of 140 millimeters and extends through said resonance chambers to said first gas expansion chamber, projecting into the latter for a length of 34 millimeters;

said portion of said induction pipe has respective aperture means communicating with the respective said resonance chambers, and said exhaust gas outlet pipe has an internal diameter of 140 millimeters and a portion which extends into said third gas expansion chamber for a length of 138 millimeters.

2. Silencer as defined in claim 1, wherein said respective aperture means which communicate with said first resonance chamber comprise six radially-arranged, angularly equidistant tubular members each having an internal diameter of 30 millimeters and a length of 20 millimeters.

3. Silencer as defined in claim 1, wherein said respective aperture means which communicate with said second resonance chamber comprise six radially-arranged, angularly equidistant tubular members each having an internal diameter of 30 millimeters and a length of 20 millimeters.

4. Silencer as defined in claim 1, wherein said respective aperture means communicating with said third resonance chamber comprise ten radially-arranged, angularly equidistant ports each with a diameter of 20 millimeters.

5. Silencer as defined in claim 1, wherein each said tubular duct supported by said fourth baffle-plate is provided with a stiffening collar.

6. Silencer as defined in claim 1, wherein each said tubular duct supported by said fifth baffle-plate is provided with a stiffening collar.

7. Silencer as defined in claim 1, wherein said portion of said outlet pipe extending into said third gas expansion chamber is provided with a stiffening collar.

* * * * *